US005395235A

United States Patent [19]

Lan-Sun Hung

[11] Patent Number: 5,395,235

[45] Date of Patent: Mar. 7, 1995

[54] CATALYTIC PREBURNER

[75] Inventor: Stephen Lan-Sun Hung, Clifton Park, N.Y.

[73] Assignee: General Electric Company, Schenectady, N.Y.

[21] Appl. No.: 281,311

[22] Filed: Jul. 27, 1994

Related U.S. Application Data

[63] Continuation of Ser. No. 41,372, Apr. 1, 1993, abandoned.

[51] Int. Cl.[6] ..... F23D 14/12

[52] U.S. Cl. ..... 431/352; 60/39.06; 60/723; 431/328

[58] Field of Search ..... 60/39.06, 723; 431/7, 431/352, 353, 328

[56] References Cited

U.S. PATENT DOCUMENTS 4,926,645 5/1990 Iwai et al. ..... 60/723

FOREIGN PATENT DOCUMENTS 59-7722 1/1984 Japan ..... 60/723

*Primary Examiner*—Carroll B. Dority

*Attorney, Agent, or Firm*—Patrick R. Scanlon; Paul R. Webb, II

[57] ABSTRACT

This invention relates to the use of a catalytic preburner for heating the pair from compressor discharge temperatures to above the light-off or extinction temperatures of a catalytic combustor. Such structures of this type, generally, eliminate the diffusion flame during steady-state operation and produce a preburner/catalytic combustor system capable of achieving less than 1 ppm $NO_x$.

2 Claims, 1 Drawing Sheet

CATALYTIC PREBURNER

This application is a continuation of application Ser. No. 08/041,372, filed Apr. 1, 1993, and now abandoned.

BACKGROUND OF THE INVENTION

1. Field of the Invention

This invention relates to the use of a catalytic preburner for heating the air from compressor discharge temperatures to above the light-off or extinction temperatures of a catalytic combustor. Such structures of this type, generally, eliminate the diffusion flame and produce a preburner/catalytic combustor system capable of achieving less than 1 ppm $NO_x$.

2. Description of the Related Art

The rate of the thermal $NO_x$ production in gas turbine combustors is a function of temperature, pressure, and residence time. For example, under typical gas turbine combustor conditions, thermal $NO_x$ may form in significant concentrations at at high temperatures, (e.g., 1600° C. (2912° F.)). Thus, to prevent thermal $NO_x$ formation, one must avoid operation at high temperatures by premixing the fuel and air so that the adiabatic flame temperature is maintained at lower temperatures. The lean fuel/air ratios needed to satisfy this criteria, however, produce a fuel/air mixture that is difficult to burn given the constraints found in gas turbine combustors (e.g., pressure drop and residence time considerations). In catalytic combustors, this lean fuel/air mixture is burned by using heterogeneous catalytic surface reactions to promote and stabilize homogeneous gas phase reactions.

Since 1970, many studies have been made of catalytic combustors in controlled experiments. Despite a significant research effort, however, catalytic combustors have not yet been applied to gas turbine applications. One of the main obstacles is that under the severe operating conditions found in gas turbine combustors (i.e., relatively low air inlet temperatures, high pressures, high flow rates and low residence time), no catalyst has been developed that is active under the required operation conditions.

Recently, a catalytic reactor has been demonstrated with an extinction temperature of approximately 454° C. (850° F.). These threshold temperatures are, however, above the compressor discharge temperature (e.g. 350° C. (662° F.)). In order to use this catalyst, the preburner must always be used to heat the incoming air from compressor discharge temperatures (350° C.) to the higher reactor light-off and extinction temperatures.

The present preburners, however, are based on a conventional diffusion flame that produces $NO_x$. This is inherent in diffusion flames as a hot flame front is formed between the fuel and air. The present idea seeks to replace the diffusion flame in the preburner by a catalytic combustor (i.e., a catalytic preburner).

It is apparent from the above that there exists a need in the art for a catalytic preburner which heats the air from the compressor discharge temperatures to above the light-off or extinction temperatures of a catalytic combustor, and which at the same time eliminates the use of a conventional preburner, but at the same time is capable of achieving less than 1 ppm $NO_x$. It is a purpose of this invention to fulfill this and other needs in the art in a manner more apparent to the skilled artisan once given the following disclosure.

SUMMARY OF THE INVENTION

Generally speaking, this invention fulfills these needs by providing a catalytic combustor having a catalytic preburner, comprising a catalytic preburner means having a preburner catalyst, a first fuel introduction means operatively connected to said preburner, an air introduction means operatively connected to said preburner, a second fuel introduction means operatively attached to said preburner, and a catalytic reactor means operatively attached to said second fuel introduction means.

In certain preferred embodiments, the catalytic preburner means and the catalytic reactor means are constructed of similar material. Also, the air introduction means includes a preburner air introduction means and a secondary air introduction means.

In another further preferred embodiment, the amount of $NO_x$ produced by the catalytic combustor is significantly reduced because the conventional preburner is replaced by the catalytic preburner.

The preferred catalytic preburner, according to this invention offers the following advantages: the ability to heat the air from the compressor discharge temperatures to above the extinction temperature; lower light-off temperatures; elimination of the diffusion flame during steady-state operation; reduced $NO_x$; good stability; good durability; good economy; and high strength for safety. In fact, in many of the preferred embodiments, these factors of the ability to heat the air to above the extinction temperature; reduced light-off temperatures; elimination of the diffusion flame; and reduced $NO_x$ are optimized to an extent which is considerably higher than heretofore achieved in prior, known preburners.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
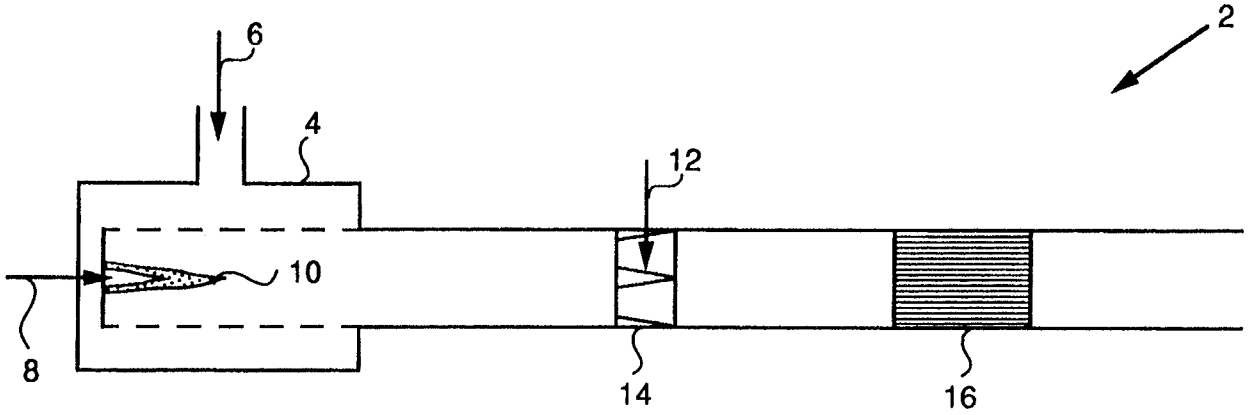
FIG. 1 (PRIOR ART)
FIG. 1 is a schematic illustration of a current catalytic combustor design with a diffusion flame preburner, according to the prior art.

With reference first to FIG. 1, there is illustrated a typical catalytic combustor 2. Combustor 2 includes, in part, diffusion flame preburner 4, air inlet 6, preburner fuel inlet 8, diffusion flame 10, main fuel inlet 12, multi-venturi fuel nozzle 14, and catalytic reactor 16.

Although the use of catalytic combustor 2 for a gas turbine application has the potential of producing less than 1 ppm $NO_x$, to date, no catalyst 16 has been found that is active at compressor discharge temperatures under typical operating conditions of gas turbine combustors. A typical gas compressor discharge temperature is approximately 350° C. (662° F.). To maintain complete stable combustion, it is necessary to provide additional heating to the compressed air by burning a fraction of the fuel in preburner 4. Even a well designed preburner 4 (with a conventional diffusion flame 10), however, will produce measurable levels of $NO_x$. Although it has been estimated that catalytic combustor 2 creates $NO_x$ that can be maintained at less than 10 ppm at base load conditions even with preburner 4 lit to maintain complete catalytic combustion, any amount of $NO_x$ greater than 1 ppm makes catalytic combustion system 2 look less attractive when compared to competing low $NO_x$ systems.

Figure 2:
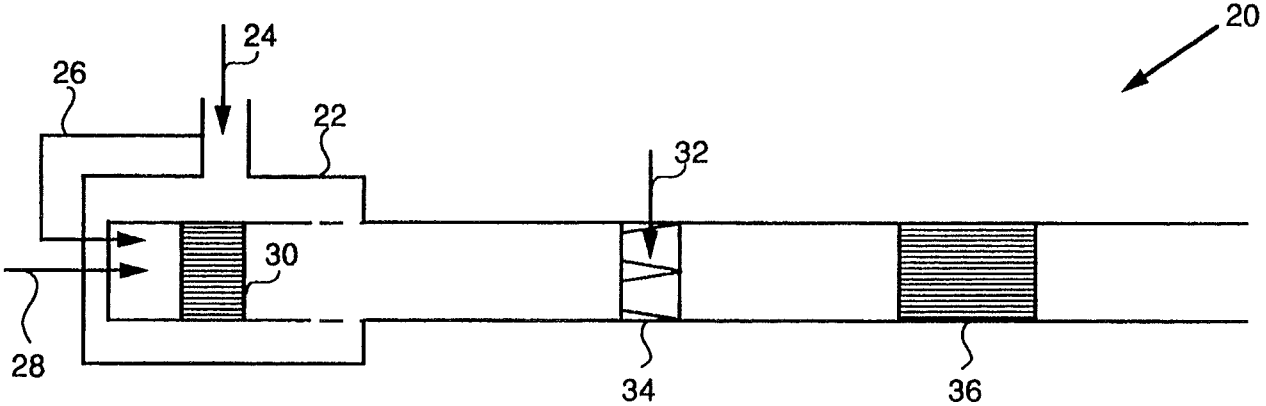
FIG. 2 is a schematic illustration of a catalytic combustor design with a catalytic preburner, according to the present invention.

FIG. 2 illustrates catalytic combustor 20. Combustor 20 includes, in part, catalytic preburner 22, air inlet 24, preburner air inlet 26, preburner fuel inlet 28, preburner catalyst 30, main fuel inlet 32, multi-venturi fuel nozzle 34, and catalytic reactor 36. Preburner 22 and reactor 36, preferably, are constructed of any suitable high temperature, oxidation catalyst.

With respect to the operation of combustor 20, a fraction of the air would be diverted into catalytic preburner 22 through preburner air inlet 26 and fuel nozzle 34 would be used to deliver a uniform fuel/air mixture. Because only a fraction of the total air would be used, the superficial velocities through catalytic preburner 22 can be much lower than the velocities passing through main catalytic reactor 36. The reduced flow rates extend the operating range of catalyst 36 so that lower light-off and extinction temperatures would be achieved. Essentially, the catalytic preburner 22 would be a catalytic combustor operating at lower flow rates.

It is to be underestood that during the operation of combustor 20, a conventional diffusion flow preburner, as shown in FIG. 1, may be needed to start-up combustor 20. However, once combustor 20 is operating, the conventional preburner would be removed and the catalytic preburner 22 would then be operated.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A catalytic combustor comprising:

a housing having a main fuel inlet and an air inlet;

a preburner disposed in said housing at one end thereof, said preburner having a catalyst disposed therein and a preburner fuel inlet;

a catalytic reactor disposed in said housing, downstream of said preburner; and means for diverting a small portion of the air from said air inlet into said preburner, and for diverting a major portion of said air from said air inlet into a space between said housing and said preburner then into a section of said housing downstream of said preburner and upstream of said catalytic reactor, said main fuel inlet being located between said preburner and said catalytic reactor.

2. The combuster of claim 1 wherein said main fuel inlet comprises a multi-venturi fuel nozzle.

* * * * *